US005361617A

United States Patent [19]

Dittlo

[11] Patent Number: 5,361,617

[45] Date of Patent: Nov. 8, 1994

[54] DEVICE FOR DRAWING SHEET MATERIAL ON A DRAWING DIE COMPOSED OF ELASTICALLY YIELDABLE MATERIAL

[75] Inventor: Michel Dittlo, Courbevoie, France

[73] Assignee: Isoform, Puteaux, France

[21] Appl. No.: 66,660

[22] Filed: May 25, 1993

[30] Foreign Application Priority Data

May 27, 1992 [FR] France ..... 92 06502

[51] Int. Cl.[5] ..... B21D 39/08

[52] U.S. Cl. ..... 72/57; 72/465; 29/421.1

[58] Field of Search ..... 72/57, 56, 63, 465; 29/421.1

[56] References Cited

U.S. PATENT DOCUMENTS

| | | | |
|---|---|---|---|
| 4,770,015 | 9/1988 | De Smet | 72/57 |
| 4,833,903 | 5/1989 | De Smet | 72/57 |
| 5,081,859 | 1/1992 | De Smet | 72/57 |

FOREIGN PATENT DOCUMENTS

| | | | |
|---|---|---|---|
| 0165133 | 12/1985 | European Pat. Off. . | |
| 2462262 | 2/1981 | France . | |
| 2641217 | 7/1990 | France . | |
| 1683841 | 10/1991 | U.S.S.R. | 72/57 |

*Primary Examiner*—David Jones

*Attorney, Agent, or Firm*—Cushman, Darby & Cushman

[57] ABSTRACT

The device having a die formed by a cushion (2) composed of an elastically yieldable material, such as for example an elastomer, disposed in a retaining box (1), a mechanism for predrawing a sheet blank (6), constituted by an outer slide carrying an upper blank holder (4a), a mechanism for finally drawing said sheet blank (6), constituted by a central slide acting on a plunger (5), and a first mechanism (10) for absorbing excess volume of the cushion (2) relative to the volume determined by the surface of the finished part to be obtained in the course of the final drawing of the part. The device further comprises at least one second mechanism (20) for compensating for the excess volume of the cushion (2) due to variations in physical characteristics of the material of the cushion.

17 Claims, 5 Drawing Sheets

DEVICE FOR DRAWING SHEET MATERIAL ON A DRAWING DIE COMPOSED OF ELASTICALLY YIELDABLE MATERIAL

The present invention relates to a device for drawing sheet material on a drawing die composed of elastically yieldable material.

A device is known from FR-A-2 641 217 for drawing sheet material of the type comprising a cushion composed of an elastically yieldable material disposed in a retaining box, means for predrawing a sheet blank constituted by an outer slide carrying an upper blank holder, and means for finally drawing said sheet blank constituted by a central slide acting on a plunger.

This device further comprises means for absorbing the excess volume of the elastically yieldable cushion relative to that determined by the surface of the finished part to be obtained.

This device permits the drawing of a sheet material, in particular a material having a low elongation which may be in particular a metal sheet, for example of steel. This device is not limited to the drawing of metal sheets but is also applicable to plastic materials and any other composite material.

The cushion composed of elastically yieldable material may be a composite support constituted by a block which is substantially a parallelepiped and based on a silicone elastomer having a low Shore hardness, optionally covered on its upper surface and on the whole or a part of its lateral surfaces with a relatively thin cover composed of a harder and stronger material.

In the course of the predrawing stage, the blank holder applied on the peripheral portion of the sheet blank causes the flow of the mass of the elastically yieldable cushion so as to deform the central portion of said sheet blank while imparting thereto, at the end of the predrawing stage, a surface substantially equal the surface of the part to be obtained.

The descent of the plunger for the final drawing of the sheet blank results in a rise in pressure in the cushion and a difference in the volume of said cushion, between the predrawing stage and the final drawing stage, which has to be compensated for so as to avoid an increase in pressure in the cushion.

Indeed, this rise in pressure is incompatible with a correct mechanical behaviour of the presses employed.

For this purpose, the device disclosed in FR-A-2 641 217 comprises means for absorbing the excess volume of the elastically yieldable cushion created upon application of the plunger.

These absorbing means are movable in the course of the final drawing of the part and this movement is adjusted by an adjusting means formed for example by a multiplate brake, a spring or a jack.

This known device permits absorbing large, constant and defined differences of volume during the first cycle of the press for a given geometry of the parts to be formed and at a given temperature.

However, this device has a drawback in that it can not cope with the problems of a progressive, and even small, increase in the volume of the cushion.

This increase may be due to variations in the physical characteristics of the material of the cushion, as for example a continuous heating of a few tens of degrees generated by the deformation of the cushion under the action of the upper blank holder the travel of which may represent 20% of the uncompressed height of the cushion during the fabrication of parts at a high rate of press operation, i.e. higher than around ten cycles per minute.

These variations in the physical characteristics of the material of the cushion involve successive adjustments of the press, and this reduces the production rates.

An object of the invention is to fabricate parts with a press operating at a high rate without need to modify the adjustment of the press during the drawing operations.

The present invention therefore provides a device for drawing sheet material, of the type comprising a die formed by a cushion composed of an elastically yieldable material, such as for example an elastomer, disposed in a retaining box, means for predrawing a sheet blank, constituted by an outer slide carrying an upper blank holder, means for finally drawing said sheet blank, constituted by a central slide acting on a plunger and a first means for absorbing the excess volume of the cushion relative to the volume determined by the surface of the finished part to be obtained in the course of the final drawing of said part, characterized in that it comprises at least one second means for compensating for the excess volume of the cushion due to variations in the physical characteristics of the material of said cushion in the course of the predrawing and the final drawing of said part.

According to other features of the invention:

the compensating means is disposed in a wall of the retaining box, the compensating means comprises, on one hand, at least one slidable element which is disposed in a chamber opening onto the interior of the retaining box and is adapted to cooperate with the cushion and, on the other hand, an element for adjusting the displacement of the slidable element interposed between said slidable element and the bottom of said chamber, the chamber is open on the wall of the retaining box, the chamber is closed in the region of the wall, of the retaining box by an elastically yieldable diaphragm, the slidable element is formed by a substantially planar sole having a surface which is flush with said wall of the retaining box, the sole has on the periphery thereof at least one shoe for guiding the sole in the chamber, the adjusting element is formed by an elastically yieldable element, the elastically yieldable element cooperates with a prestressing means, the prestressing means is formed by a rod subjected to the action of the elastically yieldable element and having a first end connected to the sole and a second end provided with an adjusting nut which bears against a plate interposed between said elastically yieldable element and the bottom of said chamber, the elastically yieldable element is formed by a block of rubber or elastomer, the elastically yieldable element is formed by spring, the adjusting element is formed by a hydraulic system connected to an accumulator adjusting the pressure, the adjusting element is formed by a pneumatic system.

A better understanding of the invention will be had from the following description which is given solely by way of example with reference to the accompanying drawings, in which.

Figure 1:
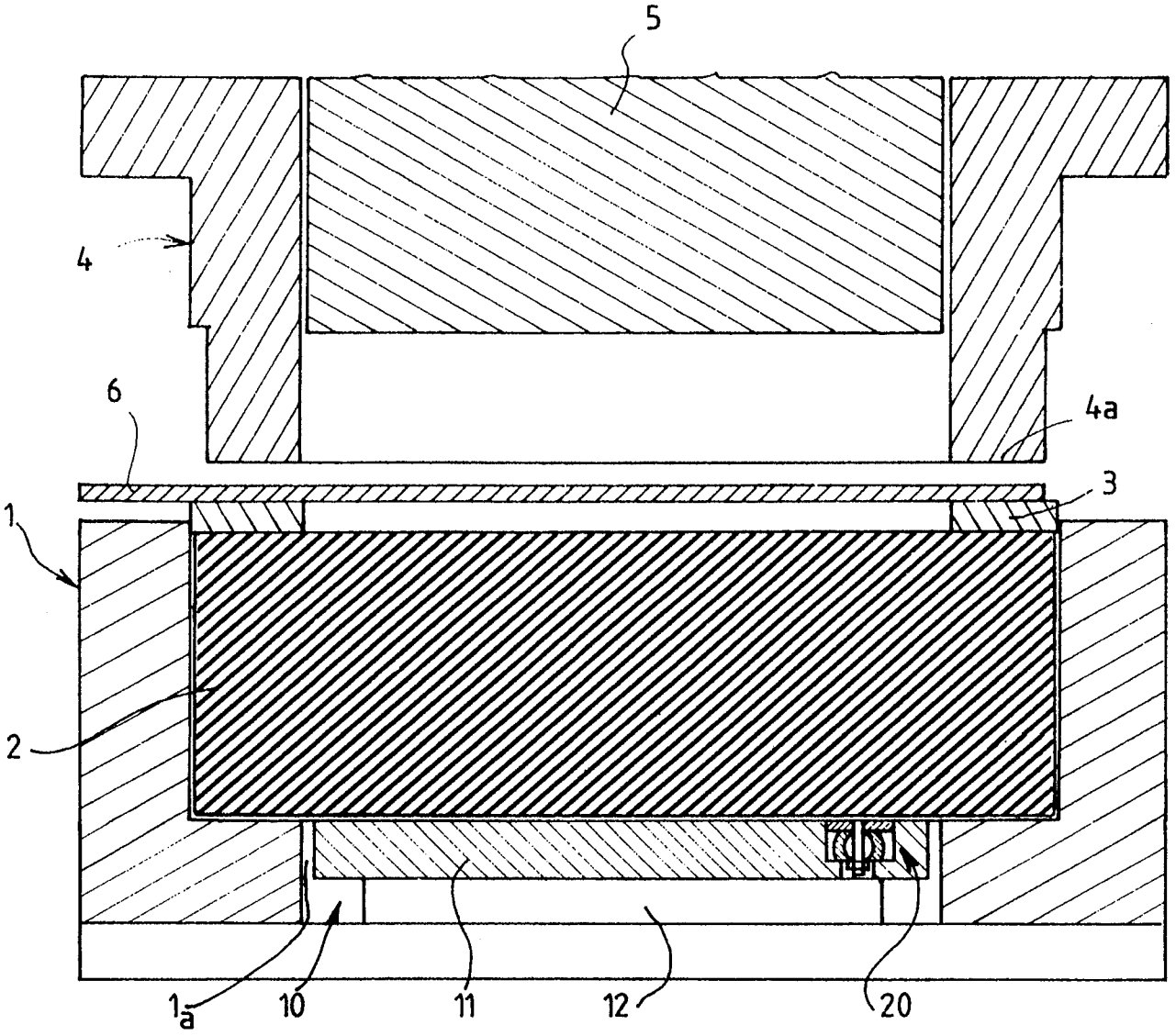
FIGS. 1 to 3 are diagrammatic sectional views of the drawing device according to the invention, in the course of successive stages in the drawing of a part.
Figure 2:
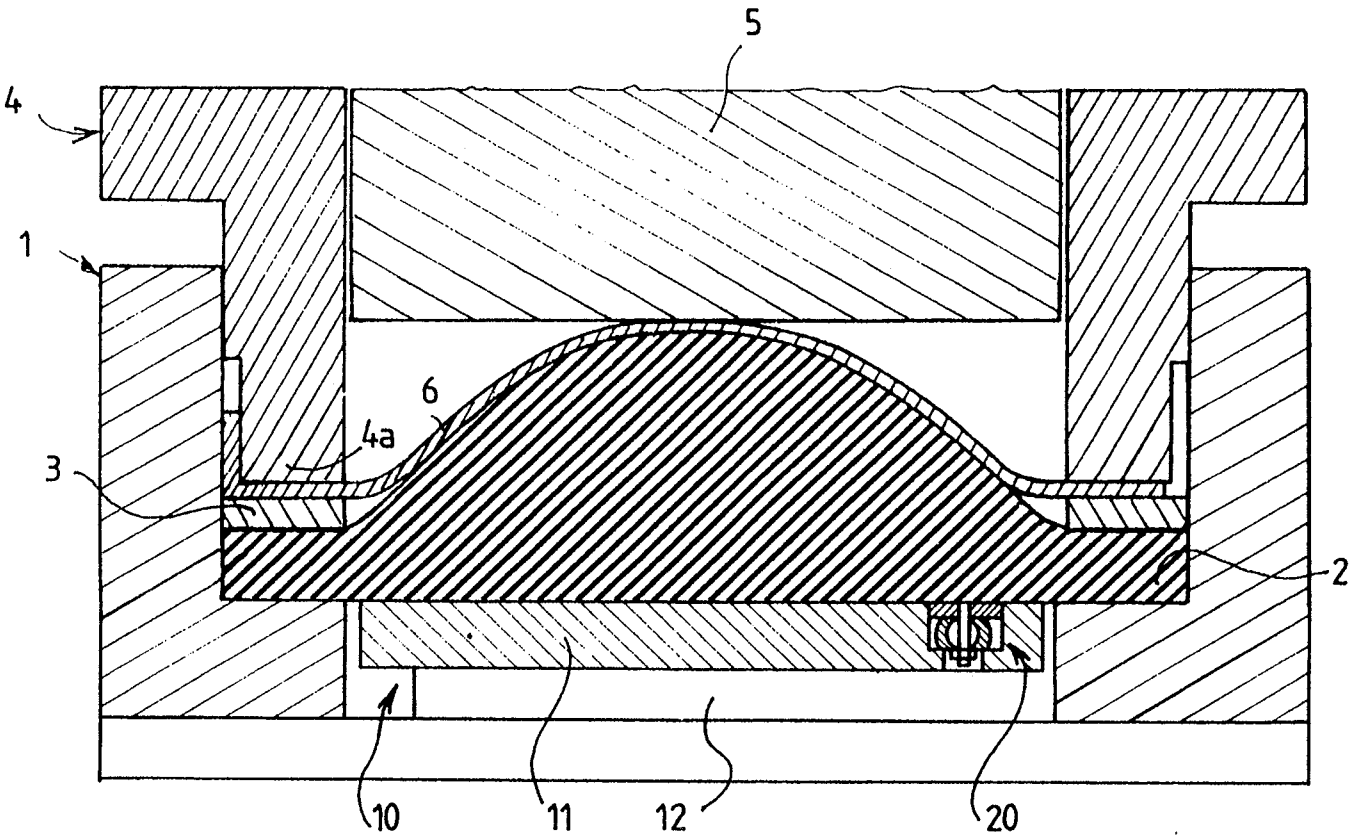
Figure 3:
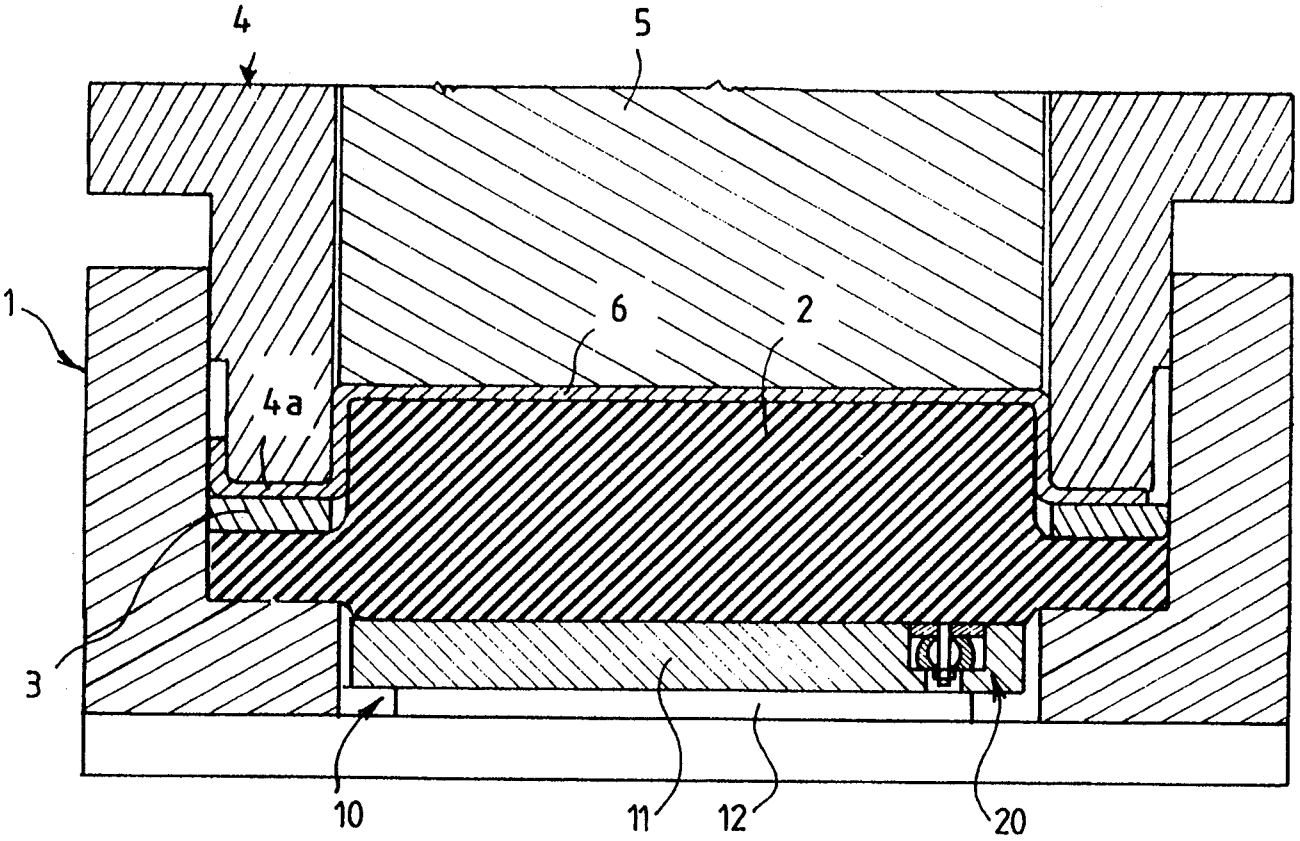

The drawing device shown in FIGS. 1 to 3 comprises a box 1 whose central part constitutes a cavity for a die formed by a cushion 2 composed of an elastically yieldable material, such as for example an elastomer.

Disposed on the upper surface of the elastically yieldable cushion 2 is a frame 3 having a closed contour and constituting a lower peripheral blank holder and substantially matching the contour of the cavity of the box 1 so as to be capable of entering said cavity when drawing the part.

Above the box 1, the drawing device comprises a body 4 carried by an outer slide or ram (not shown) the lower portion of which constitutes an upper peripheral blank holder 4*a*.

The upper peripheral blank holder 4*a* has outside dimensions which are slightly less than the contour of the cavity of the box 1 so as to cooperate with the frame 3 and penetrate said cavity.

The body 4 defines a central well in which extends a plunger 5 whose lower surface defines an impression corresponding to the profile of the finished part to be obtained.

The device further comprises a first means 10 for absorbing the excess volume of the elastically yieldable cushion 2, created by the application of the plunger 5, relative to volume determined by the surface of the finished part to be obtained in the course of the final drawing of said part.

This means 10 is constituted, in the presently-described embodiment, by a vertically displaceable piston 11 constituting the bottom of the retaining box 1 which includes for this purpose a central opening 1*a*. The piston 11 has an upper surface applied against the elastically yieldable cushion 2 and cooperates with an adjusting element 12 for adjusting the displacement of said piston.

This adjusting element 12 is diagrammatically represented in FIGS. 1 to 3 and comprises for example a multiblade brake, a spring or a jack.

In the course of the predrawing stage illustrated in FIG. 2, the body 4 is made to descend by means of the outer slide or ram (not shown) of the press in such manner that the upper blank holder 4*a* comes into contact with the sheet blank 6 the peripheral region of which is progressively clamped between the lower blank holder 3 and the upper blank holder 4*a* so as to avoid the creation of waves in the blank.

In the course of the descent, the upper blank holder 4*a* compresses by reaction the elastically yieldable cushion 2.

Under the effect of this peripheral action, the cushion acts by a flowing of the elastically yieldable material on the central zone of the sheet blank 6 and deforms it.

The bulging of the central portion of the sheet blank 6 is limited by the bottom of the plunger 5 so as to avoid uncontrolled deformations.

Right from the start of the descent of the upper blank holder 4*a*, the adjusting element 12 prevents the displacement of the piston 11 under the effect of the pressure exerted in the elastically yieldable cushion 2 and consequently prevents the elastically yieldable cushion from flowing downwardly.

During the stage of the final drawing of the sheet blank 6 shown in FIG. 3, the plunger 5 descends to its lower position and controls the final drawing of the central portion of the sheet blank 6 which was preformed in the preceding operation.

The stresses created by the bearing of the plunger 5 against the top of the sheet blank 6 cause the displacement of this blank in all of the available volume and thereby permit the final drawing of the part with a minimum variation in the thickness.

The adjusting element 12 adjusts the displacement of the piston 11 and consequently permits absorbing the excess volume of the elastically yieldable cushion 2 created by the application of the plunger 5.

While such a device is acceptable for absorbing large, constant and defined differences in volume from the beginning of the first press cycle, calculated in accordance with the part to be formed, it is not adapted to progressive, even small, increases in volume of the elastically yieldable cushion 2 due to variations in the physical characteristics of the material of the cushion, such as for example a continuous heating of several tens of degrees owing to operation of the press at a high rate, usually higher than or equal to ten cycles per minute and a rate of compression of the lateral part which may be as much as 20%.

This small increase in volume results in a high increase in the pressure in the elastically yieldable cushion 2 and a higher force on the slide of the press.

In body-work transfer presses, a plurality of tools are juxtaposed on the same slide and a suitable adjustment of only the drawing tool on the elastically yieldable cushion in the course of mass production of the parts cannot be envisaged.

In order to remedy these increases in volume due to variations in the physical characteristics of the elements of the device, and in particular of the elastically yieldable cushion, the pressure generated in the cushion is maintained at an adjusted value by an automatic compensation for the excess volume of said elastically yieldable cushion.

For this purpose, the device comprises at least one second means 20 for compensating for the excess volume of the elastically yieldable cushion 2.

This compensating means is disposed in a wall of the retaining box 1 and for example in the displaceable piston 11, as shown in FIGS. 1 to 3.

Figure 4:
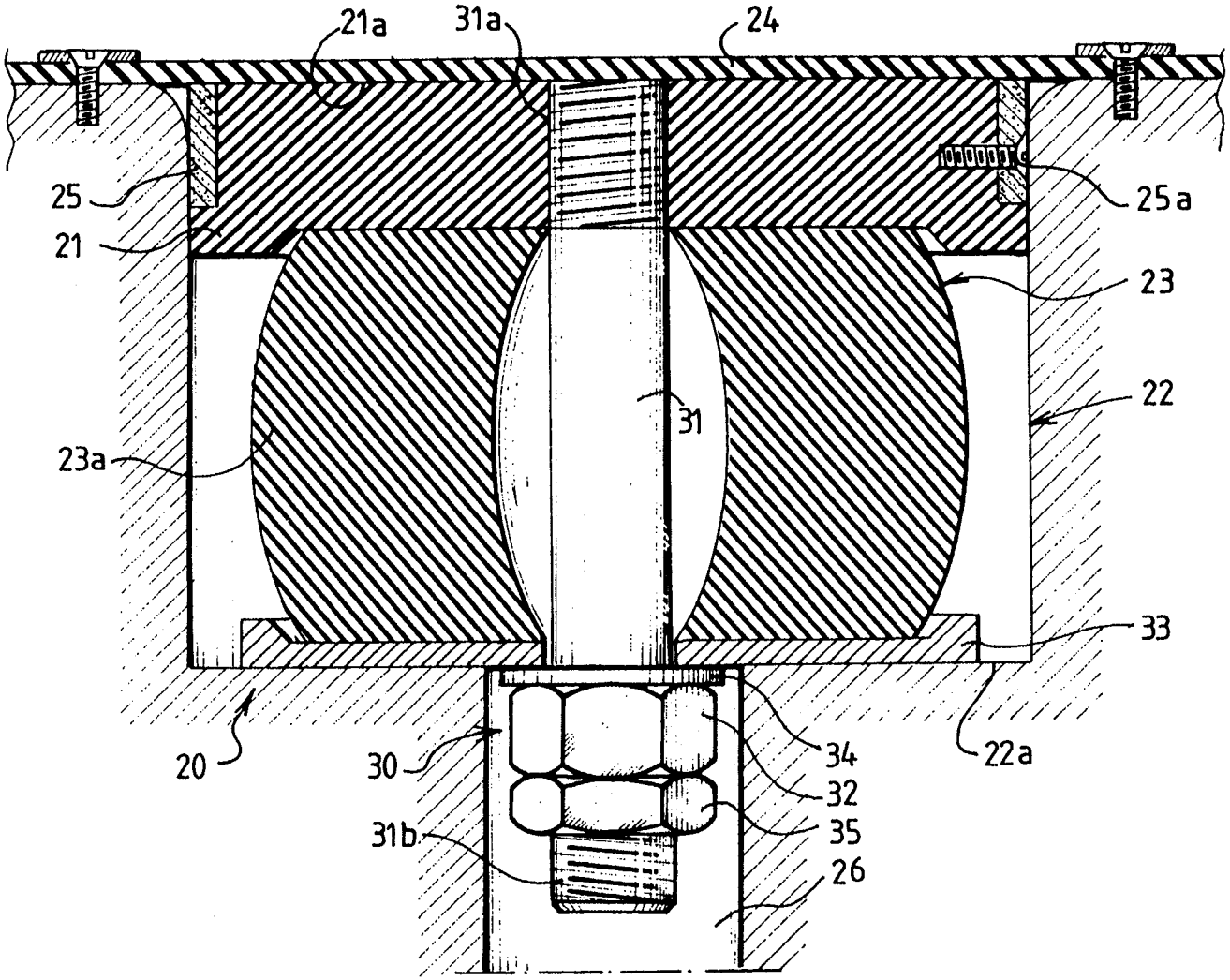
FIG. 4 is a sectional view, to a larger scale, of means for compensating for the excess volume of the cushion, in the position of rest of this means.
Figure 5:
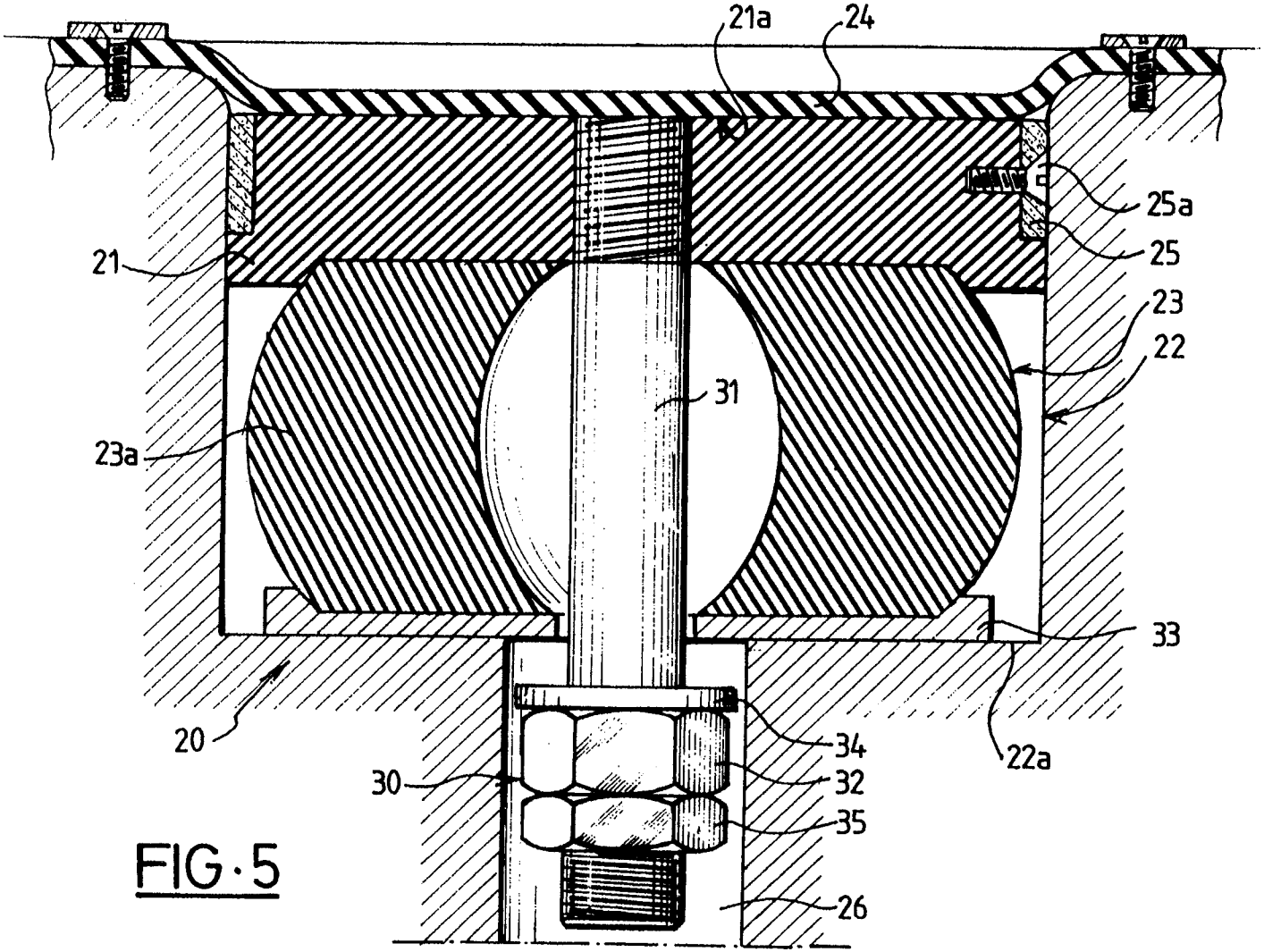
FIG. 5 is a view, identical to FIG. 4, of the means for compensating for the excess volume of the cushion in the course of the absorption of this excess volume.

As shown in more detail in FIGS. 4 and 5, the compensating means 20 comprises, on one hand, at least one slidable element 21 disposed in a chamber 22 opening onto the interior of the retaining box 1 and adapted to cooperate with the elastically yieldable cushion 2 and, on the other hand, an adjusting element 23 for adjusting the displacement of the slidable element 21, interposed between said slidable element 21 and the bottom 22*a* of the chamber 22.

The chamber 22 may be open on the corresponding wall of the retaining box I or closed in the region of said wall by an elastically yieldable diaphragm 24 so as to seal the elastically yieldable cushion 2 off from the device.

The slidable element 21 is formed by a substantially planar sole having a surface 21*a* flush with the corresponding wall of the retaining box 1 and having on the periphery thereof at least one shoe 25 for guiding the sole 21 in the chamber 22.

These shoes are made from a material having a good resistance to friction and are fixed on the periphery of the sole 21 by screws 25*a*.

The chamber 22 is extended by a cavity 26.

The adjusting element 23 is formed by an elastically yieldable element 23*a* which cooperates with a means 30 for prestressing the elastically yieldable element 23*a*.

The means 30 for prestressing the elastically yieldable element 23*a* comprises a rod 31 subjected to the action of said elastically yieldable element 23*a* and for example extending through the latter. A first end 31*a* of the rod 31 is connected to the sole 21, for example by a screw thread, and a second end 31*b* of the rod is provided with an adjusting nut 32 which bears against a plate 33 interposed between the elastically yieldable element 23*a* and the bottom 22*a* of the chamber 22.

A washer 34 is placed between the plate 33 and the adjusting nut 32 and the latter is locked in position by a lock-nut 35.

The adjusting nut 32 and the lock-nut 35 are disposed in the cavity 26.

The elastically yieldable element 23*a* may be formed for example by a hydraulic system connected to an accumulator for adjusting the pressure or by a pneumatic system.

In the case of a progressive, even small, increase in the volume of the elastically yieldable cushion 2 due to variations in the physical characteristics of the material of said cushion, such as for example a heating, the slidable element 21 is displaced in the chamber 22 and causes a compression of the adjusting element 23, as shown in FIG. 5, and thereby absorbs the excess volume of this elastically yieldable cushion 2.

This adjusting element 23 adjusts the displacement of the slidable element 21 which has a given travel and end positions which correspond to a minimum given pressure and a maximum given pressure of the material of the elastically yieldable cushion 2.

The compensating means just described provides an automatic adjustment of the pressure and volume of the elastically yieldable cushion 2 in the course or operation of the press.

The drawing device may comprise one or more compensating means placed in a part of the bottom of the retaining box or in one of the lateral walls thereof.

In devices for drawing sheet blanks on a single-action press and tool in which the means 10 for absorbing the excess volume of the elastically yieldable cushion is not employed, the means for compensating for the excess volume of the cushion due to variations in the physical characteristics of the material of the cushion may be placed in the bottom of the retaining box or in one of the lateral walls thereof.

What is claimed is:

1. A device for drawing sheet material, comprising in combination a die having a retaining box and a cushion composed of an elastically yieldable material disposed in said retaining box, a means for predrawing a sheet blank comprising an outer slide and an upper blank holder carried by said outer slide, a means for finally drawing said sheet blank comprising a plunger, a central slide for acting on said plunger, and a first means for absorbing excess volume of said cushion relative to a volume determined by the surface of the finished drawn part to be obtained in the course of the final drawing of said part, said device further comprising at least one second means for compensating for excess volume of said cushion due to variations in physical characteristics of said material of said cushion in the course of said predrawing and said final drawing of said part.

2. A device according to claim 1, wherein said elastically yieldable material is an elastomer.

3. A device according to claim 1, wherein said at least one compensating means is disposed in a wall of said retaining box.

4. A device according to claim 2, wherein said at least one compensating means comprises a chamber opening onto said retaining box, at least one slidable element disposed in said chamber and cooperative with said cushion, and an adjusting element for adjusting displacement of said at least one slidable element and interposed between said at least one slidable element and a bottom of said chamber.

5. A device according to claim 4, wherein said at least one compensating means is disposed in a wall of said retaining box and said chamber is open on said wall of said retaining box.

6. A device according to claim 4, wherein said at least one compensating means is disposed in a wall of said retaining box and said chamber is closed in a region of said wall of said retaining box by an elastically yieldable diaphragm.

7. A device according to claim 4, wherein said at least one compensating means is disposed in a wall of said retaining box and said at least one slidable element is a substantially planar sole having a surface flush with said wall of said retaining box.

8. A device according to claim 7, comprising on the periphery of said sole at least one shoe for guiding said sole in said chamber.

9. A device according to claim 4, wherein said adjusting element is an elastically yieldable element.

10. A device according to claim 9, comprising means for prestressing said elastically yieldable element, said elastically yieldable element being cooperative with said means for prestressing said elastically yieldable element.

11. A device according to claim 10, wherein said prestressing means comprises a rod subjected to action of said elastically yieldable element and having a first end connected to said slidable element and a second end provided with an adjusting nut, and a plate interposed between said elastically yieldable element and said bottom of said chamber, said adjusting nut bearing against said plate.

12. A device according to claim 11, wherein said slidable element is a sole.

13. A device according to claim 9, wherein said elastically yieldable element is a block of rubber.

14. A device according to claim 9, wherein said elastically yieldable element is a block of elastomer.

15. A device according to claim 9, wherein said elastically yieldable element is a spring.

16. A device according to claim 4, wherein said adjusting element comprises a hydraulic system connected to an accumulator for adjusting pressure.

17. A device according to claim 4, wherein said adjusting element comprises a pneumatic system.

* * * * *